US005838800A

United States Patent [19]

Lowe et al.

[11] Patent Number: 5,838,800

[45] Date of Patent: Nov. 17, 1998

[54] APPARATUS FOR ENHANCING STEREO EFFECT WITH CENTRAL SOUND IMAGE MAINTENANCE CIRCUIT

[75] Inventors: Danny D. Lowe; Mark Williams, both of Calgary, Canada; Paul Burrowes, Castro Valley, Calif.

[73] Assignee: QSound Labs, Inc., Alberta, Canada

[21] Appl. No.: 570,516

[22] Filed: Dec. 11, 1995

[51] Int. Cl.[6] ..... H04R 5/00

[52] U.S. Cl. ..... 381/17; 381/1

[58] Field of Search ..... 381/17, 1

[56] References Cited

U.S. PATENT DOCUMENTS 4,812,921 3/1989 Mitsuhashi ..... 31/17

4,841,573 6/1989 Fujita ..... 381/106

5,440,638 8/1995 Lowe ..... 381/1

*Primary Examiner*—Minsun Oh Harvey

*Attorney, Agent, or Firm*—Fulbright & Jaworski L.L.P.

[57] ABSTRACT

A system for enhancing the effect of stereo audio signals while maintaining the central audio image includes an expander circuit that tracks the monaural information that is common to both left and right channels and that uses such monaural information to control variable attenuators that influence the inputs to the left and right audio image placement filters.

7 Claims, 2 Drawing Sheets

APPARATUS FOR ENHANCING STEREO EFFECT WITH CENTRAL SOUND IMAGE MAINTENANCE CIRCUIT

BACKGROUND OF THE INVENTION

1. Field of the Invention

This invention relates generally to systems to enhance the sound separation of two-channel stereo and, more particularly, to a system for enhancing stereo sound effects while not adversely affecting the central sound source placement that is initially present.

2. Description of the Related Art

There have been proposed various systems for expanding the stereo image present in stereo source material. Such systems expand the stereo image beyond the actual confines of the left and right stereo speakers. For example one such system is described in U.S. Pat. No. 5,440,638 and assigned to the assignee hereof. The disclosure of U.S. Pat. No. 5,440,638 is hereby incorporated by reference. One approach to such stereo enhancement is to derive the monaural material from the stereo input material and to filter that monaural information and add it back to the input signal of the other side. The monaural information is defined as that information that is common to both left and right channels. The filtering can be done in an FIR type filter with the filter coefficients selected to expand the audio image in the particular channel.

While many of the previously proposed systems perform satisfactorily in expanding the stereo imaging, the problem arises that the systems actually work too well. That is, the common monaural information at the center of the stereo sound field is spread left and right to the derogation of the original content of the material. Frequently, when sound recordings are made the audio engineer places the lead vocal and another instrument in the center of the sound field and the drums, bass, and other instruments to the left and right. When such source material is passed through a stereo enhancement system as described above, the lead vocal and/or instruments are spread or distributed to the left and right speakers, with the result that an audible hole appears in the sound field. Such a hole is undesirable but has been accepted as the price to pay for enhanced stereo separation or a widened sound field.

OBJECTS AND SUMMARY OF THE INVENTION

It is an object of the present invention to provide an improved stereo enhancement system that overcomes the drawbacks inherent in the previously proposed systems.

It is another object of the present invention to provide a stereo enhancement system that can detect the central sound image in stereo program information and control the stereo enhancement filters to ignore the central audio image information so as not to have an audible hole in the resultant sound field.

In accordance with an aspect of the present invention a system is provided for dynamic tracking of an input music signal, so that the center music information is not spread. However, if the music information is already spread to the left and right stereo speakers, the resultant sound field will be spread even further. This is accomplished by an expander circuit that tracks the monaural information that is common to both the left and right channels and that is in phase between the left and right channels.

The above and other objects, features, and advantages of the present invention will become apparent from the following detailed description of illustrative embodiments to be read in conjunction with the accompanying drawings.

DETAILED DESCRIPTION OF PREFERRED EMBODIMENTS

Figure 1:
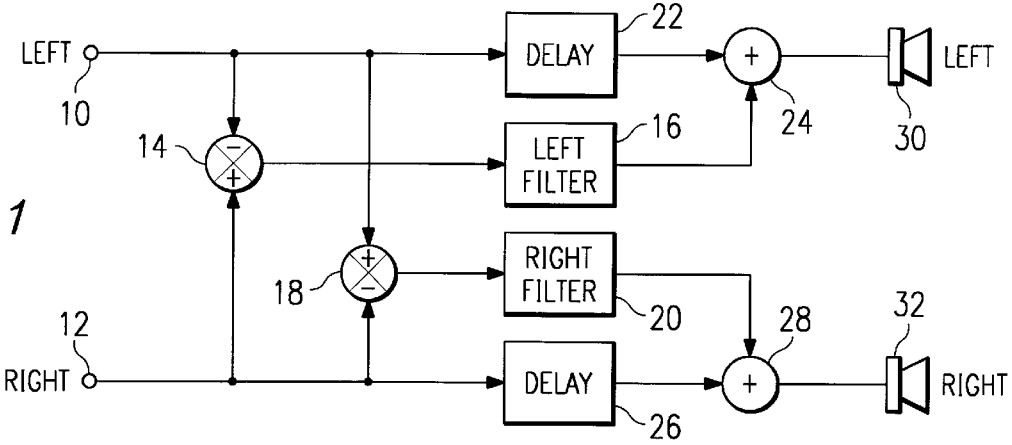
FIG. 1 is a schematic in block diagram form of a previously proposed stereo enhancement system.

In the previously proposed stereo enhancement system shown in FIG. 1, stereo left and right program information is provided at inputs 10 and 12, respectively, and the monaural information common to the left and right channels is eliminated from the channel signal in a subtractor 14 and the resultant signal is fed to a left sound placement filter 16. Filter 16 is called the left placement filter because it is used to form the left channel output signal, however, it should be understood that the input signal to filter 16 represents the right audio image. Similarly, the monaural information common to the right and left channels is eliminated from the channel signal by a second subtractor 18, with the resultant signal being fed to a right sound placement filter 20. As noted above, the right sound placement filter 20 actually receives the left audio image information for use in producing the right channel output signal.

After the left signal input at terminal 10 has been delayed in a delay unit 22 it is combined with the output from the left sound placement filter 16 in a signal adder 24. Similarly, after the right signal input at terminal 12 has been delayed in a delay unit 26 it is combined with the output from the right sound placement filter 20 in a signal adder 28. The signal output from adder 24 has enhanced left channel information and is fed to the left stereo speaker 30, and the-signal output from adder 28 has enhanced right channel information and is fed to the right stereo 32. Thus, it is seen that the stereo sound field is enhanced or spread but at the expense of the sound information at the center of the sound field.

Figure 2:
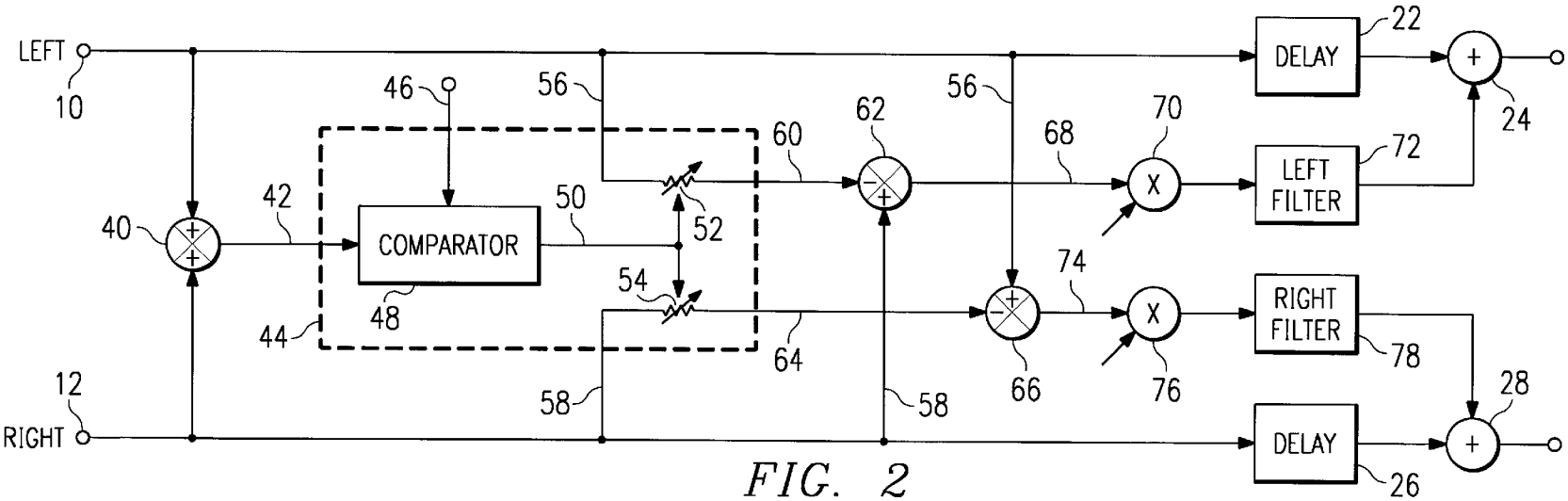
FIG. 2 is a schematic in block diagram form of a stereo enhancement system according to an embodiment of the present invention.

In the embodiment of the present invention shown in FIG. 2, dynamic tracking of the stereo music information is provided so that when the center sound stage contains the important information it is not subjected to the stereo enhancement procedure. More specifically, the left channel signal at input 10 and the right channel signal at input 12 are combined in an adder 40 to form a so-called gate signal 42. This gate signal 42 is fed to an expander shown within the broken line 44. A generalized form of the expander 44 is shown in FIG. 3.

An expander is functionally a dynamic attenuator that compares a gate signal with a threshold signal and provides an attack signal or a release signal depending on whether the gate signal is less than the threshold or greater than the threshold, respectively. The attack signal or the release signal is used to operate on an input signal to expand it or not.

Figure 3:
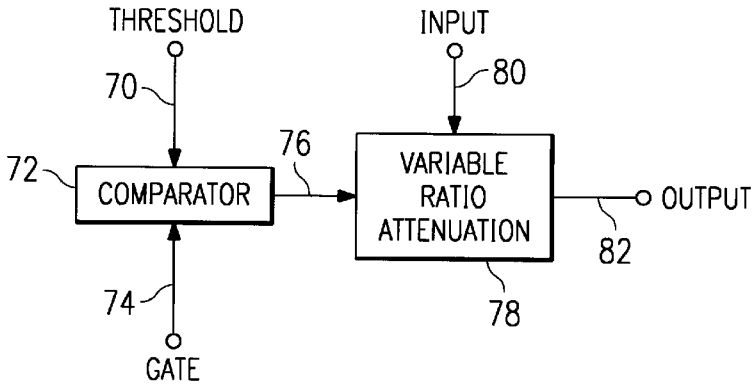
FIG. 3 is a representation of the expander of FIG. 2 having only one input and output.

FIG. 3 shows an expander that has only a single output, whereas as shown in FIG. 2 the expander of the present invention has two inputs and two outputs, not including the gate signal. The expansion operation is based on a comparison between the gate signal and the threshold signal, with the result being used as an attack signal or release signal to control a variable ratio attenuator. More specifically, in FIG. 3 a threshold signal 70 is fed to a comparator unit 72 that also receives a gate signal 74.

Figure 4A:
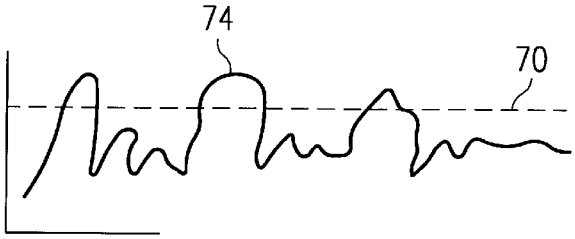
FIG. 4 is graphical representations of examples of the functions of the expander of FIG. 3.

The operation of the comparator 72 is shown in FIG. 4A, in which the gate signal 74 at times rises above the threshold 70. This relationship gives rise to the attack or release signal which is the basis for the dynamic attenuation.

Figure 4B:
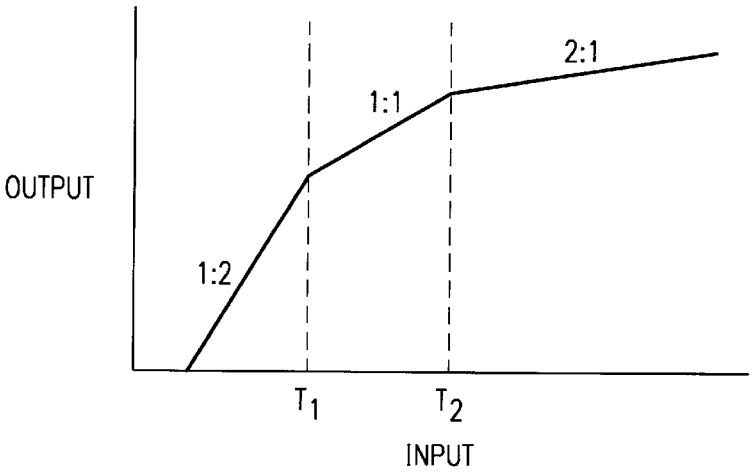

As shown in FIG. 4B, when the gate signal 74 exceeds the threshold $T_1$ the attenuation ratio is chosen as 1:1, whereas when the threshold $T_1$ is not exceeded the attenuation ratio is 1:2. This means that when the gate signal is at a high level it will be attenuated more than if it was at a lower level.

Thus, in the system of FIG. 3 when the gate signal 74 is higher than the threshold $t_1$ the output of the comparator 76 will control the variable ratio attenuator 78 to have an attenuation ratio 1:1 between the input 80 and the output 82. That is, there will be no attenuation. On the other hand, when the gate signal 74 is less than the threshold $T_1$ there is a large amount of attenuation applied between the input 80 and the output 82.

It is possible to have multiple threshold levels by varying the threshold signal 70 and, therefore, there can be multiple linear segments to the attenuation ratio curve of FIG. 4B. For example, if a second threshold $T_2$ is higher than the first threshold $T_1$ then an increased attenuation ratio, such as 2:1, can be applied. It should be understood that the response curve of FIG. 4B is just an example of operation possible by this kind of expander circuit. Note too that while 1:2 represents expander operation, 2:1 represents compressor operation.

As mentioned above, an expander system can have multiple inputs and outputs and that is the kind of expander shown at 44 in the embodiment of FIG. 2. In that embodiment, the threshold value 46, corresponding to 70 in FIG. 3, may be variable or fixed and the gate signal 42, corresponding to 74 in FIG. 3, is derived from the output of adder 40. These signals are compared in a comparator 48, corresponding to comparator 72 in FIG. 3, and an output 50 thereof is fed to control two variable attenuators 52 and 54. These two attenuators 52 and 54 correspond to attenuator 78 in FIG. 3, so the input 56 to attenuator 52, for example, corresponds to 80 in FIG. 3. Since this is a two-input/two-output expander, the second attenuator 54 also has an input 58. The output 60 of the first attenuator 52 corresponds to 82 of FIG. 3 and is fed to a subtracting circuit 62 that receives at its other input the right channel signal 58, which is also the input to the second attenuator 54.

Similarly, the output 64 of the second attenuator 54 is fed to the subtraction input of a subtractor 66 that receives at its other input the left channel signal 56, which is also the input to attenuator 52.

The output 68 of the subtractor 62 is fed through a multiplier 70 to a left channel sound location filter 72, and the output 74 of the subtractor 66 is fed through a multiplier 76 to the right channel sound location filter 78.

Be cause the minus input 60 to the subtractor 62 is controlled based upon the original signal level, the output 68 of that subtractor 62 is particularly adapted to the nature of the audio material and the stereo enhancement signal output from filter 72 will reflect the original program material. This is equally true for the other channel.

One control signal is developed in the above-described circuit to control both the left and right channels, so you can think of the system as two devices with values that are symmetrical. Nevertheless, the present invention can also be practiced in a system in which the left and right channels are different, that is, have different values.

Although the present invention has been described hereinabove with reference to the preferred embodiment, it is to be understood that the invention is not limited to such illustrative embodiment alone, and various modifications may be contrived without departing from the spirit or essential characteristics thereof, which are to be determined solely from the appended claims.

What is claimed is:

1. Apparatus for enhancing stereo effects achieved upon reproducing left and right channel stereo audio signals using left and right audio transducers, comprising:

means for combining left and right channel audio input signals to produce a gate signal;

means for comparing said gate signal with a threshold signal and producing a control signal;

variable attenuator means responsive to said control signal and receiving said left and right channel audio signal for producing respective left and right channel level-adjusted signals;

left and right audio placement filters;

first means for subtracting said left channel level-adjusted signal from said right channel audio input signal and producing a first output signal fed to said left audio placement filter;

second means for subtracting said right channel level-adjusted signal from said left channel audio input signal and producing a second output signal fed to said right audio placement filter, and signal combining means for combining an output signal from said left audio placement filter and said left channel audio input signal for producing an enhanced left channel signal fed to the left audio transducer and for combining an output signal from said right audio placement filter and said right channel audio input signal for producing an enhanced right channel signal fed to the right audio transducer.

2. The apparatus according to claim 1, further comprising:

first delay means receiving said left channel audio input signal and producing a left delayed signal fed to said signal combining means for combining with said output signal from said left audio placement filter; and second delay means receiving said right channel audio input signal and producing a right-delayed signal fed to said signal combining means for combining with said output signal from said right audio placement filter.

3. A system for improving a stereo effect provided upon reproducing left and right channel audio signals over left and right loudspeakers, the system comprising:

expander means receiving left and right audio input signals and a predetermined threshold level signal for producing left and right level-adjusted signals when a composite signal of said left and right channel audio signals is less than said predetermined threshold level;

left and right audio placement filters;

first means for subtracting said left level-adjusted signal from said right channel audio input signal and producing an output signal fed to said left audio placement filter;

second means for subtracting said right level-adjusted signal from said left channel audio input signal and producing an output signal fed to said right audio placement filter;

signal combining means for combining an output signal from said left audio placement filter and said left channel audio input signal for producing a first improved stereo effect signal fed to the left loudspeaker and for combining an output signal from said right audio placement filter and said right channel audio input signal for producing a second improved stereo effect signal fed to the right loudspeaker.

4. The system according to claim 3, wherein said expander means includes a signal adder for adding together said left and right audio input signals to form said composite signal.

5. The system according to claim 4, wherein said expander means includes a comparator for comparing said composite signal with said predetermined threshold level and producing a level adjustment control signal.

6. The system according to claim 5, wherein said expander means includes a first variable attenuator for altering the amplitude of said left channel audio input signal in response to said control signal and a second variable attenuator for altering the amplitude of said right channel audio input signal in response to said control signal.

7. The system according to claim 3, further comprising:

first delay means receiving said left channel audio input signal and producing a left delayed signal fed to said signal combining means for combining with said output signal from said left audio placement filter; and second delay means receiving said right channel audio input signal and producing a right-delayed signal fed to said signal combining means for combining with said output signal from said right audio placement filter.

* * * * *